United States Patent [19]

Luce

[11] 4,099,439

[45] Jul. 11, 1978

[54] ELECTRONIC MUSICAL INSTRUMENT WITH DYNAMICALLY RESPONSIVE KEYBOARD

[75] Inventor: David A. Luce, Clarence Center, N.Y.

[73] Assignee: Norlin Music, Inc., Lincolnwood, Ill.

[21] Appl. No.: 588,508

[22] Filed: Jun. 19, 1975

Related U.S. Application Data

[63] Continuation-in-part of Ser. No. 479,485, Jun. 14, 1974.

[51] Int. Cl.[2] ..... G10H 1/02

[52] U.S. Cl. ..... 84/1.26; 84/1.11; 84/1.13; 84/1.24; 84/DIG. 7

[58] Field of Search ..... 84/1.01, 1.13, 1.12, 84/1.17, 1.11, 1.19, 1.21, 1.24, 1.26, 1.25, DIG. 4, DIG. 8, DIG. 7, DIG. 23, 440, 423, 433–439; 331/107

[56] References Cited

U.S. PATENT DOCUMENTS

| | | | |
|---|---|---|---|
| 1,589,745 | 6/1971 | Federle | 84/433 |
| 3,234,485 | 2/1966 | Graser | 331/107 |
| 3,516,321 | 6/1970 | Harris | 84/1.26 X |
| 3,570,357 | 3/1971 | Adachi | 84/1.26 |
| 3,582,530 | 6/1971 | Adachi | 84/1.26 |
| 3,626,074 | 12/1971 | Hiyama | 84/1.26 X |
| 3,634,594 | 1/1972 | Hiyama | 84/1.26 X |
| 3,637,913 | 1/1972 | Evans | 84/1.01 |
| 3,735,076 | 5/1973 | Iijima | 84/423 X |
| 3,816,636 | 6/1974 | Peltz | 84/1.26 X |

*Primary Examiner*—Ulysses Weldon

*Attorney, Agent, or Firm*—Hill, Gross, Simpson, Van Santen, Steadman, Chiara & Simpson

[57] ABSTRACT

An electronic musical instrument has a keyboard equipped with apparatus for developing a voltage in response to the momentum of operated keys of the keyboard, which voltage is employed to control the amplitude of the sounds produced in response to each key depression. The amplitude is dependent partially upon the momentum of the key depression and partially upon the amount of time since the previous depression of the same key. An envelope generator operates in response to depression of a key and has a charge circuit for controlling attack and decay of the envelope. The discharge circuit is controlled partially by the pitch of the note selected by the depression of any given key of the keyboard. The envelope produced by the envelope generator controls a unit which functions as a combined modulator and filter, closing a path between an audio source and an output system and varying the width of the band-pass provided for the signal from the audio source in response to the amplitude of the envelope. The wave shape of the signal supplied to the output system is also modified in response to the amplitude of the envelope.

18 Claims, 14 Drawing Figures

Fig. 4
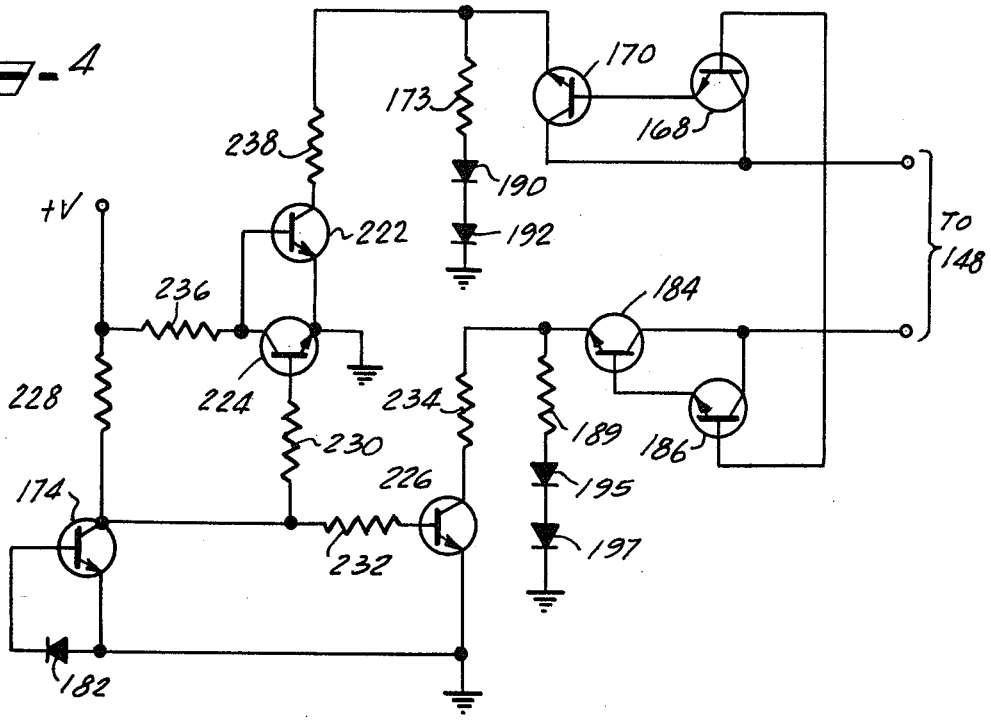
Fig. 5
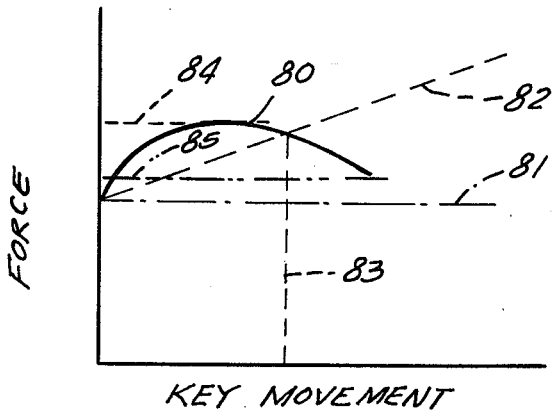
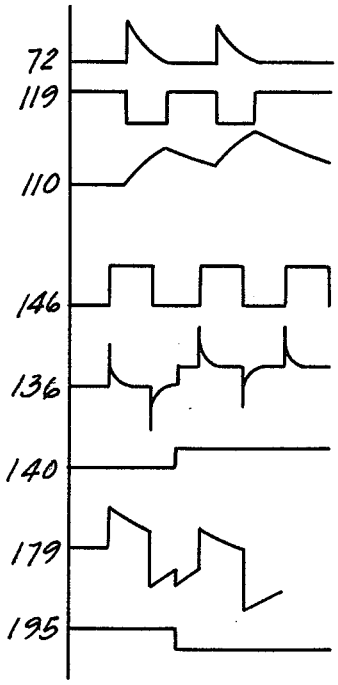
Fig. 6A

Fig. 8A
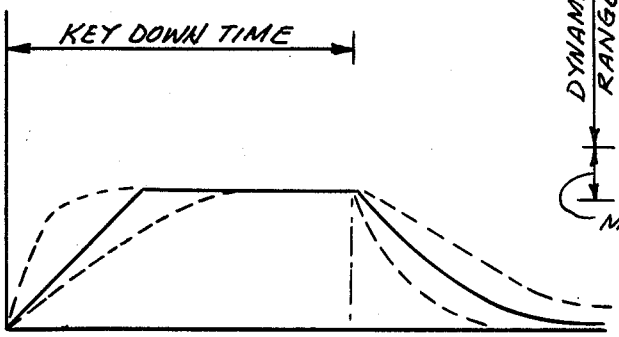
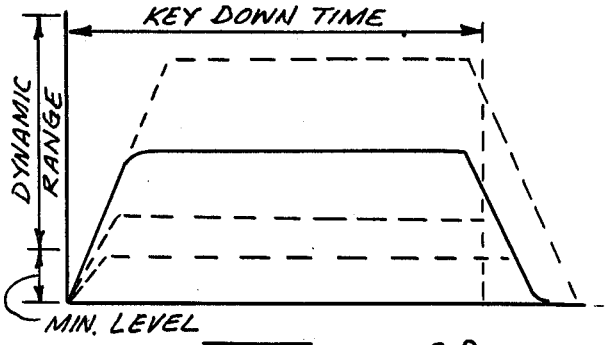
Fig. 8D
Fig. 8B
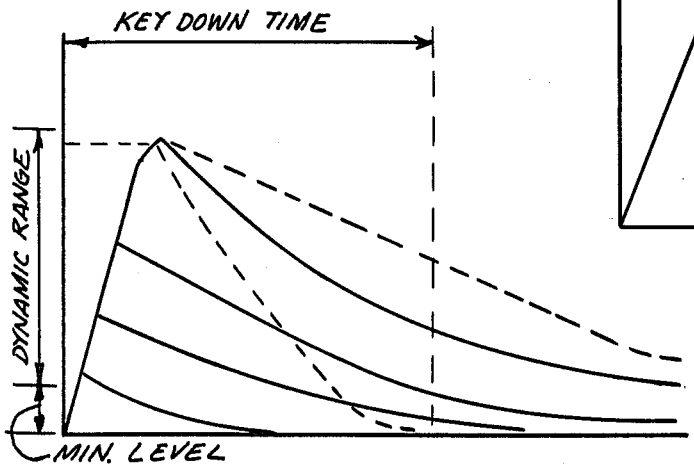
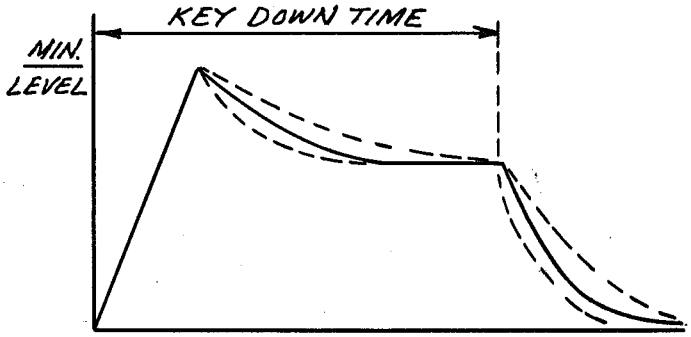
Fig. 8E
Fig. 8F
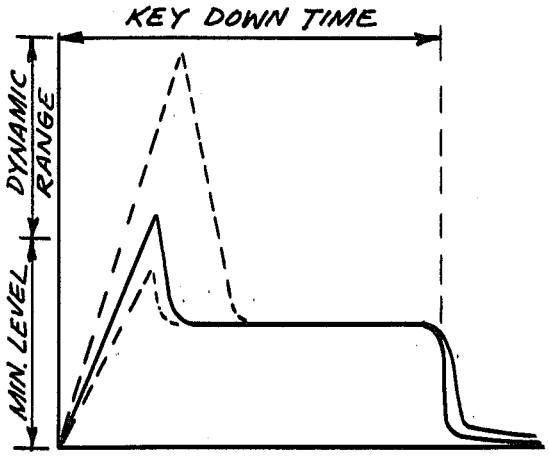
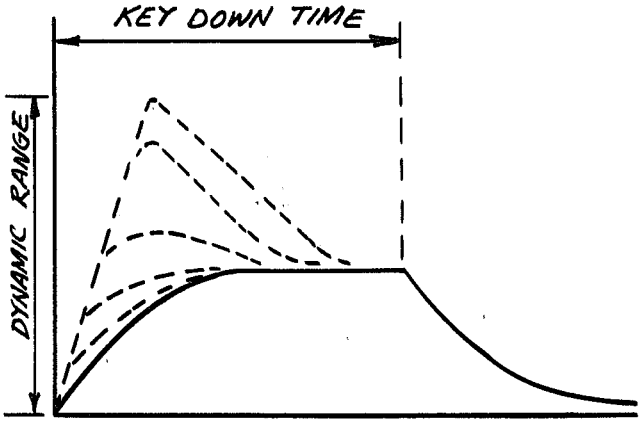
Fig. 8C

ELECTRONIC MUSICAL INSTRUMENT WITH DYNAMICALLY RESPONSIVE KEYBOARD

BACKGROUND

This is a continuation-in-part of my copending application Ser. No. 479,485, filed June 14, 1974.

FIELD OF THE INVENTION

The present invention relates to electronic musical instruments, and more particularly to electronic pianos and the like.

THE PRIOR ART

In recent years, the advent of inexpensive integrated circuits and low cost electrical and electronic components has made feasible the design and production of a large range of musical instruments which have hitherto been economically impractical. Modern electronic circuits have been embodied in electronic organs and in other musical instruments, such as electronic music synthesizers and the like. Electronic music synthesizers typically are instruments which produce only one musical sound at a time, but which permit a wide range of control over the quality of the sound through adjustment of manual controls by the operator or player. By this means, highly original sounds are readily attainable, and the player may control the tone and other qualities of the sound at will.

While electronic music synthesizers have been eminently successful in producing new and unusual sounds, it has thus far been difficult to simulate by electronic means the sound of certain conventional instruments, such as an acoustic piano. Although many attempts have been made to develop instruments which have the same playing characteristics as an acoustic piano, these efforts have been largely unsuccessful, for a variety of reasons. One of the reasons has to do with the unique "feel" or "touch" which a player senses through contact of his fingers with the keys of the keyboard. An acoustic piano responds to increased amounts of force used on the keys by playing more loudly, but a conventional electronic instrument is insensitive to the amount of force used on the keys, and produces sounds at an amplitude level which is completely independent of the force or momentum with which the keys of the keyboard are moved.

The sound qualities of piano music have also been difficult to attain by electronic means.

It is therefore desirable to provide apparatus by which the "feel" or playing characteristics of the keyboard may be made to simulate those of an acoustic piano, and by which sounds may be produced which closely simulate those of an acoustic piano.

SUMMARY OF THE PRESENT INVENTION

A principal object of the present invention is to provide apparatus for sensing the momentum of an operated key of the keyboard during movement of the key in response to being operated by a player, with apparatus responsive thereto for producing sounds of greater amplitude in response to key operations with greater momentum, and with apparatus for closely simulating the sound qualities of an acoustic piano.

Another object of the present invention is to provide apparatus responsive to the momentum with which a key of the keyboard is struck for producing sound signals which have amplitudes dependent partially upon the momentum with which a key is operated and partially upon the time interval since the previous operation of such key.

A further object of the present invention is to provide means for producing a predetermined envelope shape in response to actuation of a key, with manually operable means for controlling the rate of decay of the trailing edge of such envelope.

Another object of the present invention is to provide such apparatus with means for causing the trailing edge of the envelope to decay at a rate which is partially proportional to the pitch of the sound produced in response to the operated key.

A further object of the present invention is to provide a combination modulator and filter which is adapted to control the amplitude of signals connected to an output system in response to operation of a key of the keyboard, and to simultaneously control the frequency components of such signals.

Another object of the present invention is to provide apparatus for controlling the wave shape of signals connected to the output system in response to the amplitude of an envelope signal generated in response to depression of each key.

These and other objects and advantages of the present invention will become manifest upon a review of the following description and the accompanying drawings.

In one embodiment of the present invention there is provided a musical instrument having a keyboard with a plurality of keys adapted for producing musical sounds at a variety of pitches corresponding individually to said keys, means for sensing the momentum with which each of said keys is operated, envelope producing means responsive to said last named means for producing an envelope signal in response to the momentum with which said key is depressed and in response to the time interval since the previous depression of such key.

In another embodiment of the present invention there is provided apparatus for sensing depression of a key of the keyboard of a musical instrument and for generating, in response thereto, an envelope signal, including means for regulating the decay of such envelope signal partially in response to the pitch of the sound produced in response to such key.

In a further embodiment of the present invention there is provided apparatus for selectively closing a connection between a source of an a.c. signal and an output system, and control means associated therewith for controlling the amplitude of the a.c. signal furnished by such connection and the frequency components of such signal.

BRIEF DESCRIPTION OF THE DRAWINGS

Reference will now be made to the accompanying drawings, in which:

FIG. 4 is a schematic circuit diagram of a modification which may optionally be made in the embodiment of FIG. 3;

FIG. 5 is a graph showing the displacement-force relationship of the key of FIG. 2;

FIG. 6A is a graph illustrating certain waveforms which are produced during the operation of the apparatus of FIG. 3;

FIG. 8A–8F are a series of waveforms illustrating the operation of FIG. 7.

DESCRIPTION OF THE PREFERRED EMBODIMENTS

Figure 1:
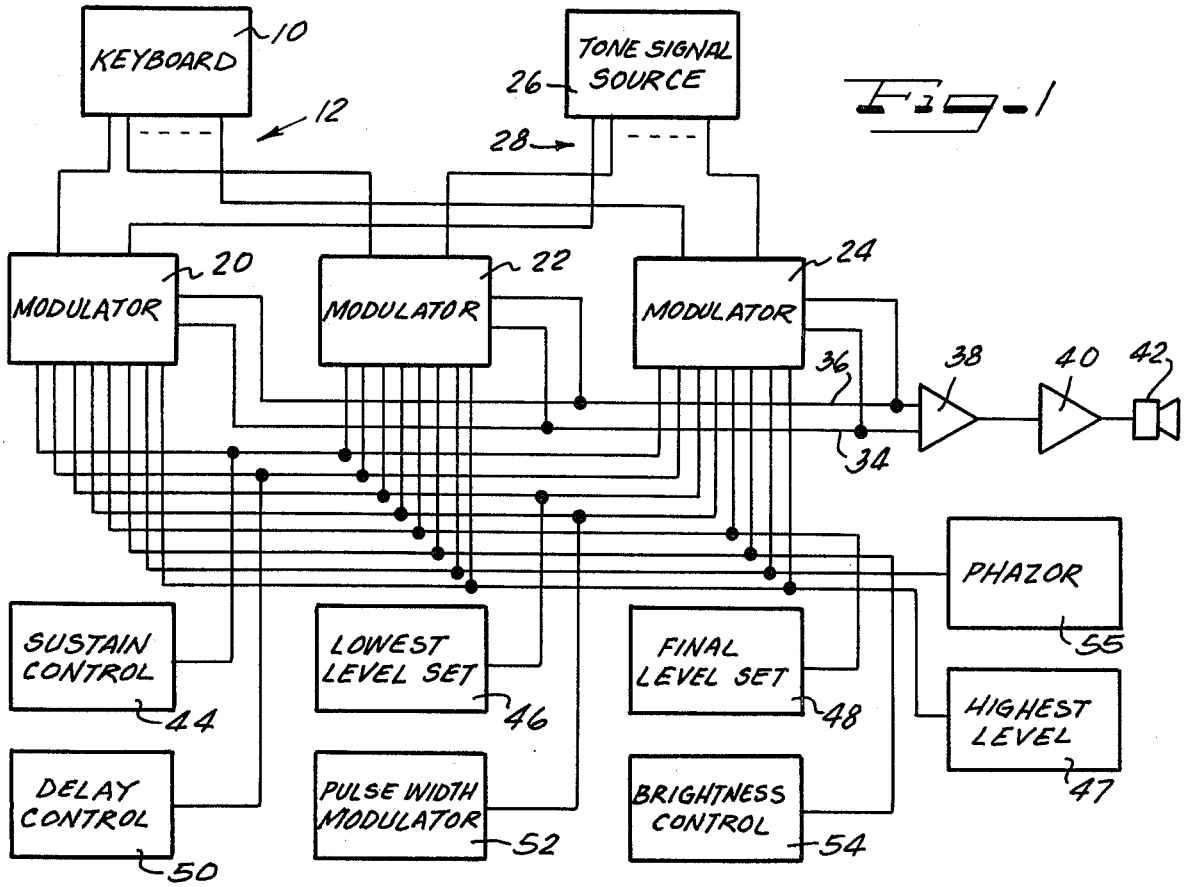
FIG. 1 is a functional block diagram of an electric piano incorporating the present invention.

Referring now to FIG. 1, a keyboard 10 incorporates a plurality of player-operable keys, each of which results in the energization of individual output lines 12. Although only three output lines 12 are specifically shown, it will be understood that the number of output lines provided is equal to one for each key of the keyboard 10. Each of the output lines is connected to the input of an individual modulator unit, such as 20, 22, and 24.

A tone signal source 26 is provided which has a plurality of outputs 28 that are connected individually to the modulator units 20, 22, and 24. A separate output line 28 is provided for each individual modulator unit. Each of the modulator units is responsive to operation of its input line 12 for establishing electrical connection between its line 28 to a pair of output busses 34 and 36. The output terminals of all of the modulator units 20, 22, and 24 are connected in parallel with the busses 34 and 36, and these busses are connected to the inputs of a differential amplifier 38, the output of which is connected through a power amplifier 40 to a loudspeaker 42.

A number of control devices are provided for establishing voltage levers which are supplied to the various modulator units 20, 22, and 24, in order to select the quality of the sound to be produced by the unit in accordance with the desires of the operator. A unit 44 is provided for controlling the time durations of the sounds passed to the output system. A unit 46 establishes the relative amplitude of the lowest level sound which is produced by the output system, which occurs in response to the slowest actuation of any of the keys of the keyboard 10, and a unit 47 establishes the highest level for the keys of the keyboard 10. A separate unit 48 is provided for controlling the maximum amplitude which can be developed by the output system in response to any operating condition.

A separate control 50 is provided for selectively modifying the rate of decay in amplitude of sounds produced by the apparatus. Two additional controls 52 and 54 are provided for selectively modifying the width of pulses supplied by the modulator units to the output system, and for modifying the brightness of the sounds, respectively. A "phazor" control 55 controls the modification of pulse width as a function of amplitude.

Figure 2:
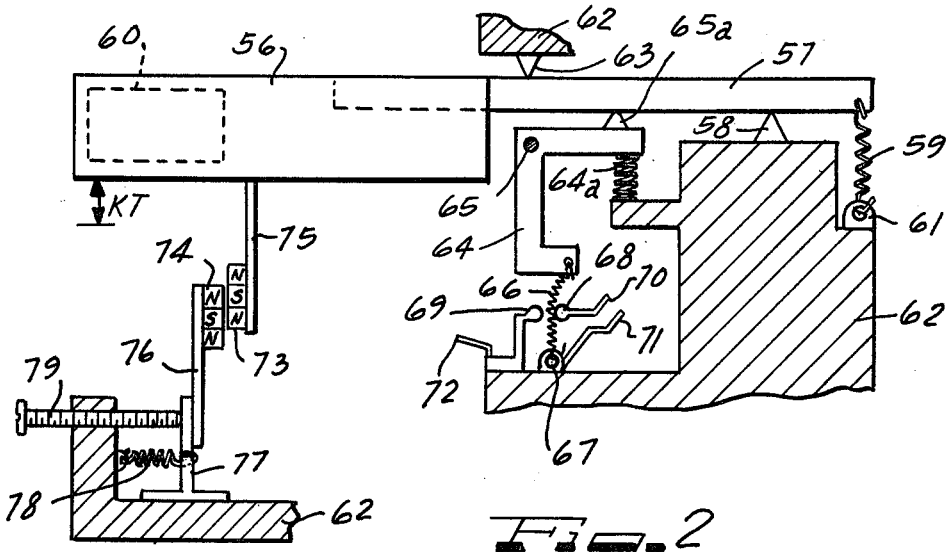
FIG. 2 is a diagrammatic illustration of one key of the keyboard of the device together with its operating assembly.

Referring now to FIG. 2, a diagrammatic illustration of the apparatus for cooperating with a single key of the keyboard is illustrated. A key 56 is connected to a channel 57 which is pivotally supported on a fulcrum 58. A weight 60 is housed within the front portion of the key 56 to establish the desired mass of the key. A spring 59, attached between the rear end of the channel 57 and a bracket 61, mounted on a portion of the frame 62, maintains the key rotated in its most clockwise position, in which the upper portion of the channel 57 bears against the stop member 63. The weight 60 is not enough to rotate the key 56 in its counterclockwise direction, but is sufficient to require a given minimum force to be applied to the key by an operator's finger in order to depress the key.

A switch level in the form of a bell crank 64, mounted for rotation on a shaft 65, is urged by a compression spring 64*a* to rotate in its counterclockwise direction, in which a pad 65*a* bears against the bottom of the channel 57. Depression of the key 56 causes the bell crank 64 to rotate in a clockwise direction. A contact spring 66 is secured at one end to the bell crank 64 and at its other end to a bracket 67 mounted on a portion of the frame 62. The contract spring is normally in contact with a conductor 68, as shown.

When the key 56 is depressed and the switch lever 64 is rotated clockwise, the upper end of the contact spring 66 is moved leftwardly, as shown in FIG. 2, opening the electrical contact with the conductor 68 and, after a time, establishing contact with a second conductor 69, which is mounted on the frame 62. The time interval between opening the contact with the conductor 68 and closing the contact with the conductor 69 is a function of the speed at which the key 56 rotates, which is in turn a function of the angular momentum imparted to it by an operator's finger. The operator, of course, is the player of the instrument. The conductor 68 is preferably a bus which runs the length of the keyboard, cooperating with the springs 66 of all of the keys in the manner shown. The spring 66 and the conductor 69 are individual to each key.

A wire 70 connects the conductor 68 to a source of positive voltage, as described hereinafter. Wires 71 and 72 are connected to the spring 66 (via the bracket 67) and the conductor 69, and these wires are connected to other apparatus shown in FIG. 3.

A magnet assembly is employed with the key 56 to provide a breakaway force when the key is depressed by an operator, using a pair of short lengths of magnetized rubber strips 73 and 74. The strip 73 is supported from the key 56 by a bracket 75, and the strip 74 is mounted on a bracket 76 connected to a T-shaped support member 77, which is supported in sliding relationship by the frame 62. The support member 77 is urged leftwardly by a tension spring 78, but is maintained in the position shown by an adjustment screw 79, which is received in a threaded bore provided in a portion of the frame 62. Rotating the screw 79 adjusts the proximity of magnet strips 73 and 74.

The strips 73 and 74 are preferably polarized oppositely at adjacent locations along the strips, and the initial position of the strips, when the key is unoperated, is shown in FIG. 2. In the initial position, the opposite poles are approximately aligned, so there is little or no magnetically-generated force tending to move the key 56 up or down. As the key 56 is depressed, however, the strip 73 moves downwardly toward a location where like poles of the strips 73 and 74 are aligned, and a force resisting downward movement of the key is thereby created. As the key is moved further downwardly past the position where like poles are aligned, a magnetically-generated force in the opposite direction is produced, tending to force the key 56 downwardly. The total key movement KT is indicated in FIG. 2.

FIG. 5 shows a graph 80 of the total force tending to resist counterclockwise rotation of the key 56, as a function of key movement. Dashed line 81 indicates the initial force, as a result of the action of springs 59 and 64a. The dashed line 82 indicates how the force of these springs increases as the key 56 is moved. The magnetically-generated forces, when added to the spring forces, cause the total force to follow the curve 80; the point at which the curve 80 crosses the dashed line 82, indicated by dashed line 83, corresponds to alignment of the magnetic poles of the strips 73 and 74. Movement past this alignment brings about a decrease in the total force resisting key movement. The difference between the maximum and final values of the total force, indicated by the distance between dashed lines 84 and 85, represents the breakaway force.

The effect of the breakaway force is to provide a certain touch or feel for the operator, which tells him, via the change in the amount of force resisting downward movement of his fingers, that the key has been operated. The amount of breakaway force is adjustable by means of the screw 79, which adjusts the magnitude of the magnetically-generated force by controlling the separation of the strips 73 and 74. The weight 60 is such as to give the key a moment of inertia of about 375.0 gm $cm^2$.

The mechanical arrangement provided for the keys of the keyboard 10 in the present invention provides a feel or touch as perceived by the player which is remarkably similar to that of a conventional acoustic piano. The added weight given to the key by means of the weight 60 tends to increase the mass of the key 56, so that it does not rotate at the slightest application of a force applied thereof, but the force must be applied over a long enough period of time to accelerate the key to the point where the movement of the key will be complete from its clockwise position to its counterclockwise position, or else a force applied for a short time must be sufficiently large to enable the requisite angular velocity to be acquired by the key in order to cause the spring 66 to reach the conductor 69. The mechanism of FIG. 2 is sensitive to the momentum applied to the key. The product of mass times velocity must exceed a predetermined minimum limit, where the mass is the effective operating mass acting on the key, and the velocity is the velocity at which the effective mass contacts the key 56. For example, if a player operates the keys very rapidly with only his fingers, a higher initial finger velocity is required than when the effective mass is greater, as it is when the player is operating by moving his hand and forearm, with his fingers being held relatively rigid. In either event, the momentum imparted to the key 56 causes the key to rotate in a counterclockwise direction, and the time during which the spring 66 is out of contact with both the conductors 68 and 69 is dependent upon this momentum.

The output signal developed on the output line 72 is a step wave form, which rises from a nominal value to a height dependent upon the time interval between opening of the circuit with the conductor 68 and closing of the circuit with the conductor 69. The circuit which employs this step wave form in order to achieve the purposes of the present invention will now be described.

Figure 3:
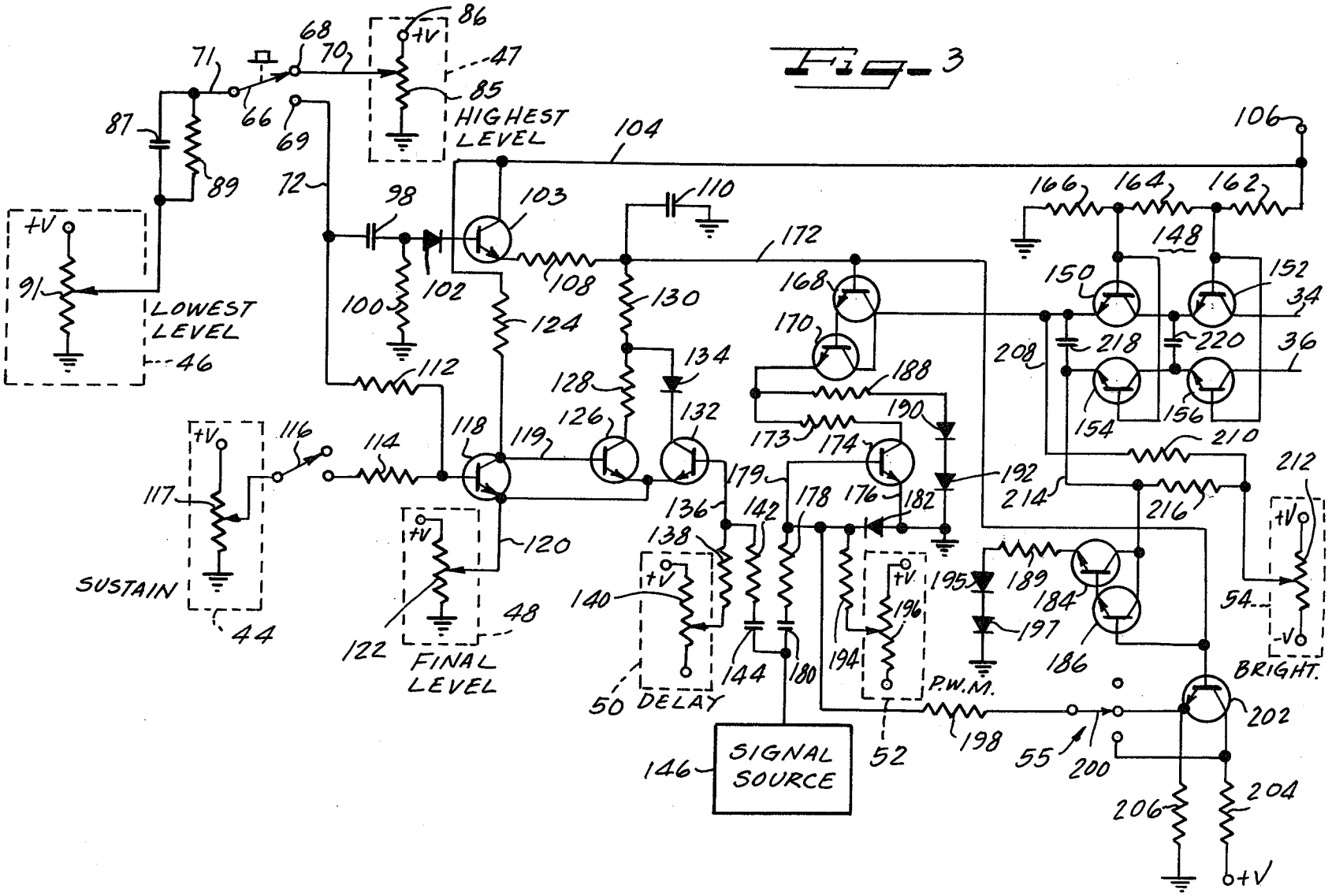
FIG. 3 is a schematic circuit diagram of apparatus connected with the keys of the keyboard in an illustrative embodiment of the present invention.

Referring now to FIG. 3, a schematic diagram of the modulator circuit of the present invention is illustrated. The step wave form is applied to the modulator over the line 72.

The switch operated by a single key 56 is illustrated in schematic form. The line 70 is connected to a source of a positive d.c. voltage at a terminal 86 through a "highest level" potentiometer 85, which normally charges a capacitor 87 through the spring 66 and the line 71. The lower terminal of the capacitor 87 is connected to the tap of a "lowest level" potentiometer 91. A resistor 89 is connected in parallel with the capacitor 87, so that as soon as the spring 66 is disconnected from the conductor 68, the capacitor 87 begins to discharge through the resistor 89. The level of charge remaining on the capacitor 87 at the time the spring 66 contacts conductor 69 is dependent upon the time interval between the spring leaving the conductor 68 and reaching the conductor 69.

When the spring 66 reaches the conductor 69, a step function is supplied to the line 72, which decays exponentially at the time constant determined by the capacitor 87 and the resistor 89, and thus forms a pulse. This time constant of the decay is on the order of eight milliseconds. The other end of the capacitor 87 is connected to the tap of a potentiometer 91, which serves as the "lowest level" control 46.

The line 72 is connected through a differentiating circuit including a capacitor 98 and a resistor 100, and the output of the differentiating circuit is connected through a diode 102 to the base of a transistor 103. The collector of the transistor 103 is connected to a line 104, which leads to a terminal 106 to which a source of positive voltage is connected. The emitter of the transistor 103 is connected through a resistor 108 and a condenser 110 to ground, so that the condensor 110 is charged by a current from the emitter of the transistor 103 at the first appearance of the pulse applied to the line 72. The maximum pulse which may be applied to the line 72, representative of the maximum speed of operation of the key 56, causes the capacitor 110 to be charged to about one-third of the level of potential of the source connected to the terminal 106, and the value of the resistor 108 is selected to permit this mode of operation. For example, in one embodiment, the capacitor 87 is 0.22 mfd., the resistor 89 is 39 K ohm, the capacitor 110 is 0.1 mfd., the resistor 108 is 47 K ohm, the capacitor 98 is 0.01 mfd., and the resistor 100 is 1 M ohm.

The line 72 is also connected, by series resistors 112 and 114, to a "sustain" potential through a switch 116, determined by the setting of a potentiometer 117 which functions as the sustain control 44. The junction of the resistors 112 and 114 is connected to the base of a transistor 118, the emitter of which is connected through a line 120 to the tap of a potentiometer 122 serving as the "final level" control 48. The collector of the transistor 118 is connected through a resistor 124 to the terminal 106.

The junction of the resistor 124 and the collector of the transistor 118 is connected to the base of a transistor 126, the emitter of which is connected to the line 120 and the collector of which is connected through resistors 128 and 130 to the junction of the capacitor 110 and the resistor 108.

The positive pulse applied to the line 72 turns on the transistor 118, with the result that the transistor 126 is turned off. As long as the transistor 118 is conducting, the transistor 126 is cut off, and no current flows from a capacitor 110 through the resistors 130 and 128. However, when the transistor 118 is cut off, base current flows to the transistor 126 through the resistor 124, and the capacitor 110 is discharged through the transistor 126 at a rate depending upon the values of the resistors 128 and 130, to the level set by the potentiometer 122.

The operation of the transistor 118 by the pulse supplied on the line 72 results in a voltage increase on the capacitor 110 which is proportional to the difference between the height of the pulse on the line 72 and the voltage present across the capacitor. Thus, rapid actuation of the same key results in a buildup of voltage on the capacitor 110. This operation may be referred to as pumping the capacitor 110 and furnishes a re-strike capability to the key and provides for an increasing volume of sound produced in response to multiple strikings of the same key, with each striking being audibly distinct. Following the decay of the pulse on the line 72, the capacitor 110 discharges through the transistor 126 to the level determined by the potentiometer 122.

Another transistor 132 is provided for varying the rate of discharge of the capacitor 110. The emitter of the transistor 132 is connected in common with the emitter of the transistor 126, and its collector is connected through a diode 134 to the junction of the resistors 128 and 130. The base of the transistor 132 is connected by a line 136 through a resistor 138 to the tap of a potentiometer 140 serving as the "decay" control 50. The line 136 is also connected through a resistor 142 and a capacitor 144 to a square wave generator 146. The generator 146 is a portion of the frequency source 26 illustrated in FIG. 1. The generator 146 produces a square wave at the frequency which corresponds to the operated key 56. The capacitor 144 and the resistor 142, together with the resistor 138, function as a differentiator and voltage divider, and cause a differential square wave to be produced on the line 136 in which the positive-going half cycles each have a relatively steep leading edge and a sloping trailing edge. The absolute level of such half cycle pulses depends upon the potential selected by the potentiometer 140. The level is selected so that only a portion of the positive-going half cycle pulses exceeds the "final level" selected by the potentiometer 122, so that the transistor 132 is conductive for only a portion of each pulse. The duration of the portion which exceeds the "final level" is dependent upon the setting of the potentiometer 140, because of the sloping waveform of the pulses. The pulse repetition rate of the half cycle pulses which drive the transistor 132 into conduction is the same as the frequency of the generator 146. The current drained from the capacitor 110 is proportional to the product of the conductance of the resistor 130 and the duty cycle for which the transistor is turned on, and therefore the time rate at which the capacitor 110 is discharged through the transistor 110 is generally proportional to the frequency of the sound selected by the operated key 56, but is also controlled by the potentiometer 140.

The time constant of the resistor 142 and the capacitor 144 is relatively short, so that the wave form of the pulses produced on the line 136 is independent of the frequency of the generator 146. Accordingly, the conduction per unit time through the transistor 132 is a function of frequency, with the result that the capacitor 110 is discharged more rapidly for high frequency sounds than for low frequency sounds. The rate of decay of the charge on the capacitor 110, as a result of operation of the transistor 132, is in addition to the decay current which flows through the transistor 126. By varying the potentiometer 140, and also by varying the value of the resistor 138 for each of the several modulators associated with the several keys of the keyboard, the relative slope of the decay curve may be controlled manually by the operator, and may be selected in accordance with the individual requirements for the sounds selected by the individual keys of the keyboard.

The modulator incorporates two pairs of transistors which together form a ladder filter 148. One pair of transistors 150 and 152 are connected with their emitter and collector terminals in series, and the second pair of transistors 154 and 156 are likewise connected in series. The transistors 150 and 152 are connected in series with a first output line 34, while the transistors 148 and 156 are connected in series with a second output line 36. The two transistors 150 and 152 operate in conjunction to sink current from the output line 34, while the other two transistors perform the same function with respect to the output line 36.

A voltage divider including resistors 162, 164, and 166 is connected between the terminal 106 and ground, and furnishes two different voltages which bias operation of the transistors 150–156. The transistors 152 and 156 have their bases connected in common to the junction of the resistors 162 and 164, while the bases of the transistors 150 and 154 are connected in common to the junction of the resistors 164 and 166.

The emitter of the transistor 150 is connected to the collectors of two additional transistors 168 and 170, which are connected together in a Darlington circuit. The transistor 168 functions as the input transistor of the Darlington circuit, and its base is connected by a line 172 to the ungrounded terminal of the capacitor 110.

The emitter of the transistor 170 is connected through a resistor 173 to the collector of a transistor 174. The emitter of the transistor 174 is connected to ground by way of a line 176, and its base is connected to the square wave generator 146 through a resistor 178 and a capacitor 180. A diode 182 is connected across the emitter base junction of the transistor 174 to prevent a negative potential from appearing at the base.

The emitter of the transistor 154 is connected to the collectors of two transistors 184 and 186, which are connected in a Darlington circuit, with the transistor 186 serving as the input transistor. The emitter of the transistor 170 is connected through a resistor 188 and a pair of diodes 190 and 192 to ground. In similar fashion, the emitter of the transistor 184 is connected through a resistor 189 and a pair of diodes 195 and 197 to ground. The bases of the transistors 168 and 186 are both connected by the line 172 to the underground terminal of the capacitor 110. The voltage across the capacitor 110 is sometimes referred to hereinafter as the "envelope signal" because it determines the amplitude of the output signal of the modulator on the lines 34 and 36.

The filter circuit 148 is described in U.S. Pat. No. 3,475,623, issued to Robert A. Moog on Oct. 28, 1969. In operation, the signal applied to the modulator over the line 172 determines the cut-off frequency of the filter, so that the filter cut-off frequency is gradually raised as the envelope signal present on the line 172 increases in amplitude, with the result that conduction of the transistor 174, as the result of the a.c. signal applied thereto from the square wave generator 146, effects an imbalance in the conduction in the two legs of the filter, and the a.c. signal is transmitted to the output lines 34 and 36. The bias current is equal in both legs of the filter, so that a differential amplifier connected to the output lines 34 and 36 is effective to cancel the bias current, and leaves only the desired a.c. signal.

The base of the transistor 174 is also connected through a resistor 194 to the tap of a potentiometer 195 which serves as the "pulse width modulator" control 52. This voltage acts to bias operation of the transistor 174, in order to vary the width of the pulses of current passed through the transistor 174. The bias set by the potentiometer 196 cooperates with a differentiating circuit including the capacitor 180, the resistor 178, and the resistor 194, so that a square wave with a sloping top is applied to the base of the transistor 174. The bias set by the potentiometer 196 is such that only the topmost portion of the positive-going half cycle of this square wave is high enough to drive the transistor 174 into conduction, so that a pulse of current is passed by the transistor 174 during the brief interval in each cycle in which the amplitude of its base exceeds its threshold conduction value. This is controllable by operation of the potentiometer 196 in order to vary the duty cycle of operation of the transistor 174. This causes a corresponding duty cycle in the output pulses appearing on the lines 34 and 36.

The base of the transistor 174 is also connected to the line 172 through a resistor 198, a transistor 202, and a switch 200 when the switch 200 is in the condition shown. The switch 200 is a single-pole, triple-throw switch, having an open position, during which the circuit including the resistor 198 is open; a second position, during which the emitter of the transistor 202 is connected to the base of the transistor 174 through the resistor 198; and a third position. When the switch 200 is in its open position, operation of the modulator is as described above.

When the switch 200 is in its second position, the bias on the transistor 174 is varied as a function of the amplitude of the envelope signal applied to the line 172. In this way, the pulse width of the output pulses is modulated in proportion to the amplitude of the envelope signal. Thus, when the envelope signal amplitude is relatively low, the pulse width of the current pulses passed by the transistor 174 is narrow, with the width being controlled by the potentiometer 196. When the envelope signal amplitude increases, the width of the current pulses passed by the transistor 174 increases. This affects a change in wave shape which produced an interesting musical quality in the output sound.

When the switch 200 is in its third position, the resistor 198 is connected to the collector of the transistor 202. The collector is also connected to a positive source of voltage through a resistor 204, and its emitter is connected to ground through resistor 206. The base fo the transistor 202 is connected to the line 172, and so the signal appearing at the collector of the transistor 202 is the inverse of the signal appearing on the line 172. Thus, when the third position of the switch 200 is selected, the width of the pulses passed by the transistor 174 is greatest at low amplitudes of the signal on the line 172, and decreases for increasing amplitudes of the envelope signal. Operation of the switch 200 enables an operator to select the desired pulse width modification or to omit the modification altogether. It constitutes, with the transistor 202, the "phazor" control 55.

The emitter of the transistor 150 is connected by a line 208 through a resistor 210 to the tap of a potentiometer 212 which functions as the "brightness control" 54. In similar fashion, the emitter of the transistor 154 is connected over a line 214 through a resistor 216 to the tap of the potentiometer 212. The potentiometer 212 is adjusted to produce a bias voltage which controls the bias current flowing through the filter circuit 148, in order to increase or decrease the degree of modification of the output signal as a result of operation of the modulator circuit. If the bias is set relatively high, by appropriate adjustment of the potentiometer 212, there is little change in the filter cut-off frequency for different voltage levels on the line 172. Thus the sound quality resulting from shifting the cut-off frequency may be reduced or accentuated, in accordance with the position of the tap of the potentiometer 212.

A capacitor 218 is connected between the emitters of the transistors 150 and 154 to prevent the potentials on the emitters from changing rapidly relative to each other. A similar capacitor 220 is connected between the emitters of the transistors 152 and 156 for the same purpose.

It will be appreciated from the above description that the apparatus of the present invention is adapted to produce a great variation in sound quality and tone. The mechanical characteristics of the keys of the keyboard are such as to closely simulate the operating characteristics of an acoustic piano. Most of the circuitry illustrated in FIG. 3 is susceptible to being embodied in integrated circuit form, so that relatively few connections must be made during assembly of a complete instrument.

Referring to FIG. 4, an alternative embodiment of the circuit of FIG. 3 is illustrated, with similar portions of the apparatus being designed by the same reference numerals. Three additional transistors 222, 224, and 226 are provided, while enable operation of the transistor 174 to apply a push-pull audio signal to both circuits of the ladder filter 148.

The transistor 174 is connected to a source of positive potential through a resistor 228 and is also connected to the bases of the transistors 224 and 226 through resistors 230 and 232, respectively. The emitter of the transistor 226 is grounded, and its collector is connected through a resistor 234 to the emitter of the transistor 184, so that a decreasing potential at the collector of the transistor 174 results in an increasing potential at the emitter of the transistor 184.

The collector of the transistor 224 is connected to a positive source of voltage through a resistor 236, and its emitter is grounded. The base of the transistor 222 is connected to the collector of the transistor 224, the emitter of the transistor 222 is connected to the emitter of the transistor 224, and the collector of the transistor 222 is connected through a resistor 238 to the emitter of the transistor 170. Accordingly, a decreasing potential at the collector of the transistor 174 brings about an increasing potential at the collector of the transistor 224, which renders the transistor 222 more conductive. Thus, the transistors 222 and 226 are driven 180° out of phase, to apply a push-pull signal to the two legs of the ladder filter 148.

It will be seen that the various controls illustrated in FIG. 3 each have a unique effect on the character of the signal produced on the output lines 34 and 36. The lowest level control sets a voltage which determines the amplitude of the pulse presented to the line 72 for the slowest possible actuation of the key 56. The highest level control sets the voltage for the fastest operation. Together they provide flexibility in permitting variations in the dynamic range of the instrument. Each time the key 56 is moved so as to close the circuit with the conductor 69, a pulse is applied to the line 72. If the capacitor 87 is completely discharged during the movement of the key, as a result of the slowness of such movement, the amplitude of the pulse applied to the line 72 is determined entirely by the setting of the potentiometer 91.

The final level control 48 is set so as to give a smoothly decaying envelope signal over a wide dynamic range.

The sustain control 44, acting in conjunction with the decay control 50, determines the rate at which the capacitor 110 is discharged after being charged each cycle.

The pulse width modulator control 52 determines the width of the pulses applied to the ladder filter 148, and the brightness control 54 controls the change in cut-off frequency of the filter 148 as a result of the amplitude of the contour, that is, the potential across the capacitor 110.

FIG. 6A illustrates some of the wave forms occurring at various portions of the circuitry during its operation.

Figure 6:
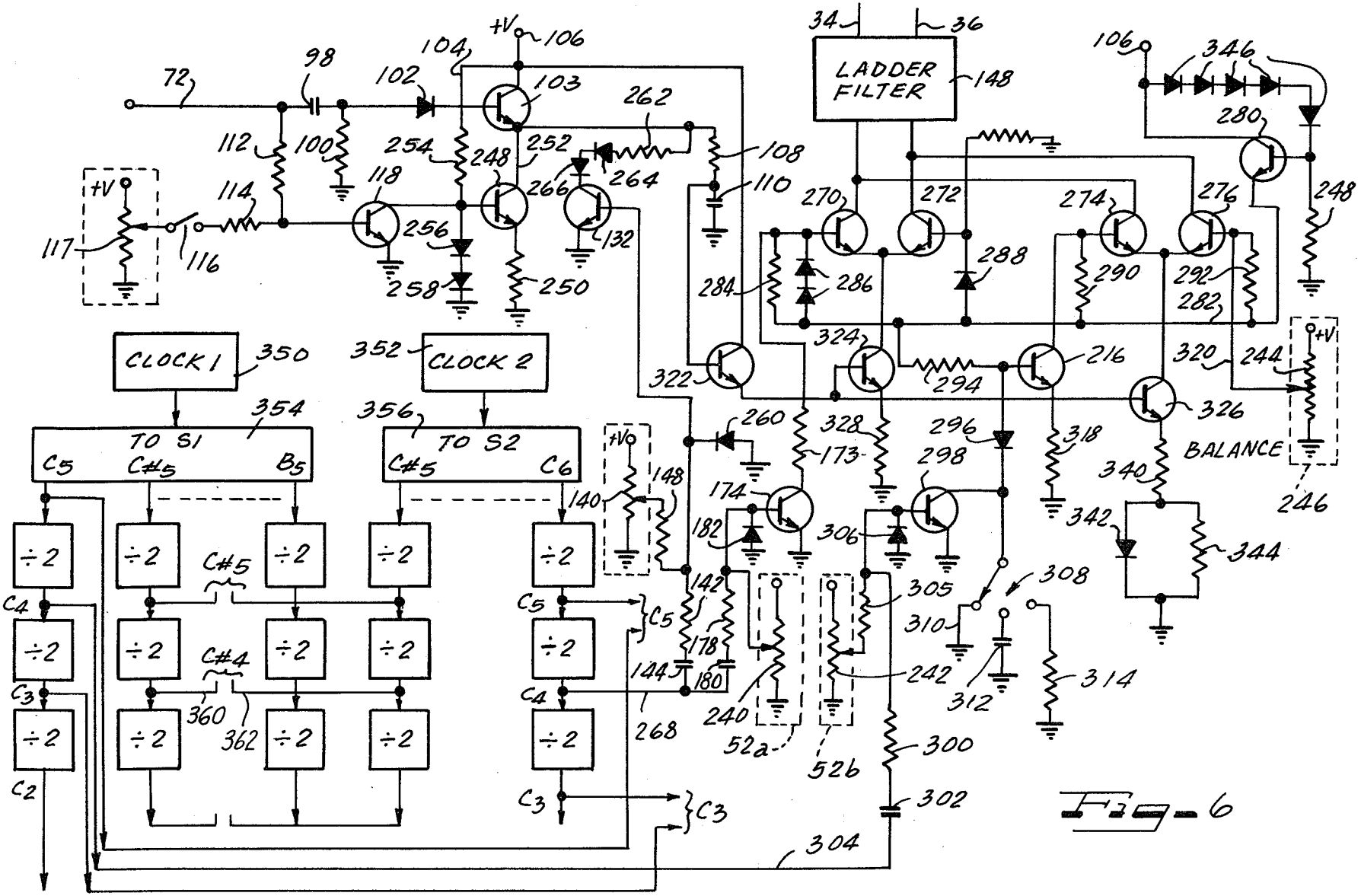
FIG. 6 is a schematic circuit diagram, partly in functional block diagram form, of another modified embodiment of the present invention.

Referring now to FIG. 6, another embodiment of the present invention is illustrated, which is capable of achieving additional operations in modifying the character of the signal produced on the output lines 34 and 36. The portions of FIG. 6 which are the same as parts of FIG. 3 have been given corresponding reference numerals.

One of the principle differences between the apparatus of FIGS. 3 and 6 is that the apparatus of FIG. 6 is adapted for the insertion of two separate and independent sources of audio signals and for pulse width modulation of each of these signals independently. The controls for controlling the pulse width modulation of the two sources are illustrated in FIG. 6 as the dashed rectangles 52*a* and 52*b* which enclose potentiometers 240 and 242, respectively. In addition, a potentiometer 244, functioning as a balance control 246, is provided for allowing an adjustment to permit equal average current levels in both of the output lines 34 and 36. Certain additional modifications have been made in the apparatus of FIG. 6, which will now be described.

The capacitor 110 is charged by conduction of the transistor 103, just as in the arrangement of FIG. 3, but the final level control has been omitted. The final level is established by the circuit parameters instead of by means of a separate control. Accordingly, the emitter of the transistor 118 is connected to ground instead of to a final level potentiometer.

The collector of the transistor 118 is connected to the base of the transistor 248, the emitter of which is connected to ground through a resistor 250 and the collector of which to the emitter of the transistor 103 by a line 252. The transistor 248 is biased by a resistor 254 connected by a line 104 from the positive voltage supply at the terminal 106 and through a pair of diodes 256 and 258 to ground. The transistor 248 is adapted to discharge the capacitor 110 through the resistor 108, except when held off by conduction of the transistor 118.

The decay control potentiometer 140 has its tap connected through a resistor 148 to the base of the transistor 132, but the emitter of the transistor 132 is connected to ground instead of to the final level control as in FIG. 3. A diode 260 is connected between the base of the transistor 132 and ground, to clamp the base to ground. The collector of the transistor 132 is connected to the junction of the emitter of the transistor 103 and the resistor 108 through a series circuit including a resistor 262 and a pair of diodes 264 and 266.

The base of the transistor 132 is also connected by the resistor 142 and the capacitor 144 to a signal source on a line 268. The line 268 is supplied with a square wave at the appropriate frequency, and the manner of its generation will be described more specifically hereinafter. The circuit including the capacitor 144 functions to partially differentiate the square wave so as to apply to the base of the transistor 132 a sloping ramp-like signal, the average level of which is controlled by means of the decay control 50*a*.

The line 268 is connected by means of the capacitor 180 and the resistor 178 to the base of the transistor 174, which functions as a pulse width modulator transistor. The circuit including the capacitor 180 partially differentiates the square wave, and the average level is determined by the pulse width modulator control 52*a* so as to cause the transistor 174 to conduct for short pulses, the length of which is determined by the setting of the pulse width modulator control 52*a*.

The input terminals of the ladder filter 148 are driven by two pairs of transistors, each of which functions to couple an independent signal to the input of the filter. The first pair of transistors includes transistors 270 and 272, and the second pair includes transistors 274 and 276. The collectors of the transistors 270 and 274 are connected in common with one input line of the filter, and the collectors of the other two transistors are in common with the other line.

The pulse width modulator transistor 174 has its collector connected by means of a resistor 173 to the base of the transistor 270, and thus functions to cause the transistor 270 to conduct current in accordance with the operation of the transistor 174.

A transistor 280, which has its collector connected to the terminal 106, has its emitter connected to a line 282 which furnishes bias to the transistors 270, 272, 274, and 276. The base of the transistor 270 is connected to the line 282 through a resistor 284 and a pair of diodes 286. The base of the transistor 272 is connected to the line 282 by a diode 288. Similarly, the bases of the transistors 274 and 276 are connected to the line 282 by means of resistors 290 and 292.

The line 282 is also connected through a resistor 294 and a diode 296 to the collector of a transistor 298, the emitter of which is connected to ground. The transistor 298 operates to inject the second signal into the input of the ladder filter 148. For this purpose, its base is connected by means of a resistor 300 and a capacitor 302 to a line 304 on which a square wave is developed by means described in more detail hereinafter. The base of the transistor 298 is also connected by a resistor 305 to the tap of a potentiometer 242, which serves to function as the second pulse width modulator control. A diode 306 is connected from the base of the transistor 298 to ground in order to clamp the base to ground. A switch 308, which is a single-pole, three position switch, has its movable pole connected to the collector of the transistor 298. In one position, the switch is connected to ground by a line 310, and in the other two positions, it is connected to ground through a capacitor 312 or a resistor 314. Grounding the collector of the transistor 298 effectively disconnects the second source and turns the second source off. When the switch 308 is connected to ground through the resistor 314, a rectangular wave is presented to the ladder filter, whereas when the switch selects the capacitor 312, a sawtooth wave form is connected to the ladder filter 148. Thus, the switch 308 is effective to determine the wave shape fo the second source applied to the input of the ladder filter 148.

The junction of the resistor 294 and the diode 296 is connected to the base of a transistor 216, the emitter of which is connected to ground through a resistor 318 and the collector of which is connected to the base of the transistor 274. The transistor 316 operates as a drive transistor for coupling the second source to the transistor pair including the transistors 274 and 276. The base of the transistor 276 is connected by a line 320 to the tap of the potentiometer 244, which is adjusted to achieve a balance of the average currents flowing in both legs of the filter.

A transistor 322 has its collector connected to the voltage source terminal 106 and its base is connected to the capacitor 110, and functions as an emitter-follower controlled by the voltage across the capacitor 110. Its emitter is connected to the bases of two additional transistors 324 and 326, which have their collectors connected respectively to the emitters of the transistors 270 and 272 and to the emitters of the transistors 274 and 276. The emitter of the transistor 324 is connected to ground through a resistor 328, and the emitter of the transistor 326 is also connected to ground through a resistor 340 and a parallel circuit including a diode 342 and a resistor 344. The transistors 324 and 326 operate to supply bias current to the emitters of the two transistor pairs in proportion to the voltage across the capacitor 110, thereby serving to simultaneously vary the cut-off frequency of the filter in the manner described above in connection with FIG. 3, and to modulate the amplitude of the output signal.

Bias for the transistor 280 is supplied by means of a voltage divider incorporating a plurality of diodes 346 and a resistor 348 connected in series from the terminal 106 to ground.

The circuit illustrated in FIG. 6 is eminently suitable to being formed in integrated circuit configuration in which substantially all of the circuit illustrated in FIG. 6, with the exception of the capacitors and the potentiometers, may be embodied in a single integrated circuit chip. This greatly increases the economy and ease of assembly of apparatus incorporating the present invention.

The apparatus for developing the square waves which are presented on the lines 268 and 304 will now be described. Two clock signal sources 350 and 352 are provided, which differ from each other in frequency by about six percent, or exactly one semitone. The two sources 350 and 352 are each connected to an identical top octave synthesizer unit 354 and 356, respectively, which is a device commercially available from a number of manufacturers which is adapted to provide twelve outputs, each having a frequency corresponding to the frequency of a note of the musical scale. For example, the twelve outputs available from the synthesizer 354 correspond to notes extending between C and B. These notes are designated C5 and B5, indicating a frequency one octave higher than is designated by C4 and B4, etc. Since the second clock source 352 functions at a semitone higher, the synthesizer 356 produces on its twelve outputs signals having frequencies ranging from C#5 to C6.

It is a feature of top octave synthesizers which are currently available that, although the different output frequencies differ from each other by approximately a semitone in comparing the frequencies available on adjacent outputs, there is a small but significant error, and the error is different for each pair of adjacent outputs. It is therefore apparent that by employing two synthesizers, as illustrated in FIG. 6, and by selecting outputs from the two which are nominally at the same frequency but which are not exactly so because of the fact that they are taken from different outputs of the synthesizers, it is possible to select pairs of frequency sources for each of the modulator elements of the present invention which are nearly equal in frequency but which differ by a small error from being precisely the same frequencies. This error is different for each pair of outputs. For example, the two outputs represented by the lines 268 and 304 do not bear the same relation to each other as the two outputs on lines 360 and 362. When these different but very close frequencies are used in the modulators of the present invention, a mechanical effect which occurs when frequencies are locked in phase synchronism with each other is avoided, and a much more desirable musical effect is produced.

Although in the above description only one modulator has been described in FIG. 3 and one modulator has been described in FIG. 6, it will be appreciated that a separate modulator unit is employed for each of the keys of the keyboard of the instrument. Therefore, it is necessary to have a large number of pairs of frequencies available from the signal source, which is represented by the synthesizers 354 and 356, and their divider chains which are connected to their respective outputs. It will be understood to those skilled in the art that these pairs of outputs are readily available, although only a few have been illustrated in FIG. 6.

Figure 7:
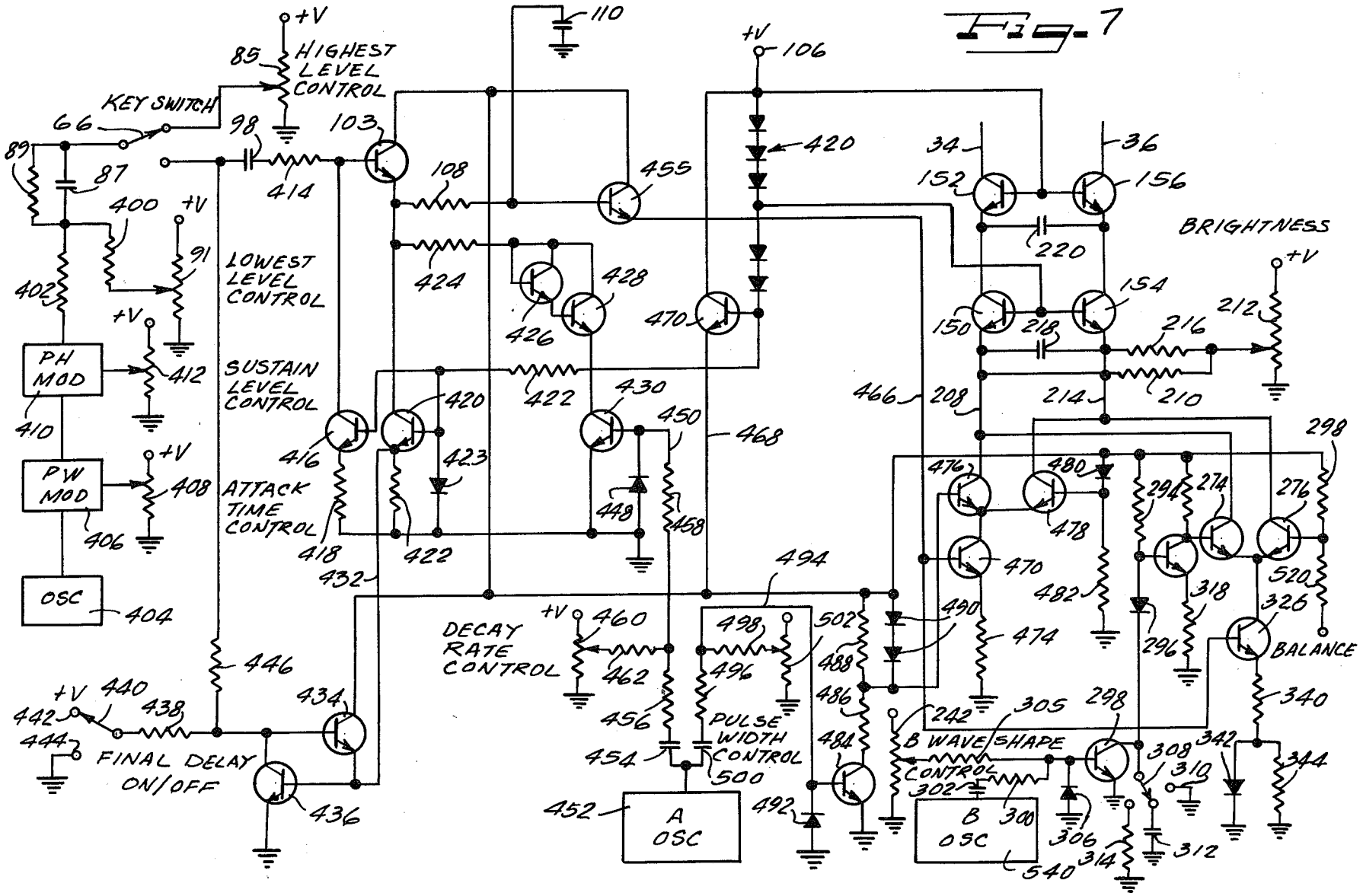
FIG. 7 is a diagram of an alternative embodiment of the present invention.

Referring now to FIG. 7, an alternative embodiment of the present invention is illustrated. The same reference numerals are used in FIG. 7 when they apply to the same components. In the apparatus of FIG. 7, the tap of the lowest level control potentiometer 91 is connected to the circuit including the capacitor 87 and the resistor 89 by a resistor 400, while another resistor 402 connects an a.c. signal to this circuit. This a.c. signal is developed by an oscillator 404, which is preferably a free running square wave oscillator having a superaudio frequency of approximately 20 kHz. Its output is connected to the input of a pulse width modulator 406, so that the widths of the pulses produced by the oscillator 404 are modulated in accordance with the setting of a potentiometer 408, and the output of the modulator 406 is connected to the input of a pulse height modulator 410, which modulates the height of the pulses produced by the oscillator 404 in accordance with the setting of the potentiometer 412. By means of the controls 408 and 412, both the width and the height of the pulses produced by the oscillator 404 can be adjusted, and the pulses are then mixed by the resistors 400 and 402 with a d.c. level developed by the potentiometer 91, and this composite signal is passed by the key switch 66 to the remaining circuitry when the key switch is closed. The effect of this a.c. signal passed through the key switch is to control the attack time, or the slope of the leading edge of an envelope waveform, and to control the level at which the envelope is sustained.

The highest level control potentiometer 85 is connected to the normally closed contact of the key switch 66. When the key switch is closed, the decaying pulse from the capacitor 87 is passed through the capacitor 98 and through a resistor 414 to the base of the transistor 103, which charges the capacitor 110 through the resistor 108. When a pulse only is applied to the transistor 103 by the key switch 66, as described in connection with the operation of FIGS. 3 and 6, the capacitor 110 is charged by the pulse and thereafter begins to decay immediately. However, when the oscillator 404 supplies a continuous train of pulses to the transistor 103, the capacitor 110 is charged in accordance with the height and width of the pulses, and develops a signal which is dependent on both the height and width of the pulses applied thereto. The height of the pulses determines the final average value of charge on the capacitor 110, while the width of the pulses determines the rate at which the envelope rises during its attack portion or leading edge. The effect of variations in these parameters is shown in the several drawings of FIG. 8A–8F, where the slope of the leading edge is seen to be variable, as well as the voltage level which is approached as the key is held down for a relatively long time. The drawings of FIG. 8A–8F also show the effect of variation in the highest level control 85 and the lowest level control 91.

A current sink circuit incorporating a transistor 416 and a resistor 418 is connected in series from the base of the transistor 103 to ground. This circuit converts the pulses applied through the capacitor 98 to a single pulse drive to charge the capacitor 110 through the transistor 103, and also serves to restore the drive voltage to a precise potential, related to the potential applied to the base of the transistor 416. This potential is derived by a circuit incorporating a plurality of diodes 420, a resistor 422 and a diode 423 connected in series to ground. The base of the transistor 416 is connected to the junction of the resistor 422 and the diode 423.

There are several paths for discharging the capacitor 110 through the resistor 108. One path is through a transistor 420 which is connected in series with a resistor 422 to ground, and another is through a resistor 424 which is connected in series with a network including transistor 426, 428 and 430 to ground.

The base of the transistor 420 is held at the same level as the base of the transistor 416, but the junction between its emitter and the resistor 422 is connected by a line 432 through a circuit including a pair of transistors 434 and 436 and through a resistor 438 to a switch 440. The switch selects either a source of positive potential at its terminal 442 or ground at a terminal 444. The resistor 438 is connected by a resistor 446 to the normally open contact of the key switch 66.

The transistor 420 is conductive or not, following release of the key 66, depending upon the position of the switch 440. If the switch 440 is connected to the terminal 442, so as to apply a high voltage level to the emitter of the transistor 420, the transistor is cut off, so that the discharge path is through the resistor 424 and the transistor is connected in series therewith. If a low level is applied to the emitter of the transistor 420, however, by selecting the ground potential with the switch 440, the transistor 420 conducts and quickly discharges the capacitor 110 upon release of the key.

The circuit including the resistor 424 and the transistors 426, 428 and 430 form the normal discharge path for the capacitor 110, following key release. A diode 448 is connected between the base of the transistor 430 and ground to prevent reverse voltage from being applied across the emitter base junction, and the base is connected by a line 450 to an A oscillator 452. The oscillator is connected to the line 450 through a differentiating circuit including a capacitor 454 and a resistor 456, and also has a series resistor 458. A decay rate potentiometer 460 has its tap connected by a resistor 462 to the junction of the resistor 456 and the resistor 458, so that the relative height of the pulse produced by the differentiating network can be raised or lowered in accordance will the setting of the potentiometer 460, which determines the width of the pulse above the threshold of the transistor 430. Accordingly, the transistor 430 is made conductive by pulses, the width of which is controlled by the control 460 and the frequency of which is determined by the oscillator 452. In this manner the capacitor 110 is discharged at a uniform rate by the pulses derived from the A oscillator 452. Suitable operation of the control 460 cuts off the transistor 430 entirely.

The transistor 455 is connected as the emitter follower to supply a voltage level to a line 466, in accordance with the voltage level start on the capacitor 110. A suitable voltage is applied to the collectors of the transistors 103, 434 and 455 over a line 468, which is connected to a source of voltage at a terminal 106 by an emitter follower 470, the base of which is connected to the bottom of a diode string 420.

The line 466 is connected to the base of a transistor 472, which has its emitter connected to ground through a resistor 474 and its collector connected to the emitters of two transistors 476 and 478, which drive two legs of a ladder filter circuit incorporating transistors 150, 152, 154 and 156, like that described in connection with FIG. 3.

The bias is supplied to the base of the transistor 478 from the line 468 through a network including a diode 480 and a resistor 482. Bias is supplied to the base of the transistor 476 by operation of a transistor 484, the emitter of which is connected to ground and the collector of which is connected to the line 468 through resistors 486 and 488. A pair of series connected diodes 490 are connected in parallel with the resistor 488.

The base of the transistor 484 is connected by a diode 492 to ground and by a line 494 to a summing network including resistors 496 and 498. The resistor 496 is connected to the output of an A oscillator 452 through a capacitor 500, and the resistor 498 is connected to the tap of a potentiometer 502, which functions as a pulse width control. Adjustment of the level of the potentiometer 502 determines the width of the pulses supplied from the A oscillator 452 to the line 494, and accordingly controls the duty cycle of operation of the transistor 484. This is turn controls the inbalance in conduction between the transistors 476 and 478, which furnishes the input to the ladder filter.

The line 466 is also connected to the base of a transistor 326, which supplies drive current to the pair of transistors 274 and 276, the collectors of which are also connected to the ladder filter. Their emitters are connected in common to the collector of the transistor 326, and the emitter of the transistor 326 is connected by a resistor 340 and a resistor 344 to ground, with a diode 342 connected in parallel with the resistor 344, just as in the circuit of FIG. 6.

The A and B oscillator of FIG. 7 are preferably both square wave oscillators which are free running at an appropriate frequency, which is high, relative to the envelope signal. Both furnish signals which are modulated by the envelope signal developed across the capacitor 110, but variation of the controls associated with the two oscillators brings about modification of the output in different ways. Operation of the pulse width control 496 causes a variable width pulse to appear in the modulated output signal, while variation of the control 242 causes variation in the waveshape of the B oscillator signal from sawtooth to a mixed rectangular sawtooth waveform (when the sawtooth capacitor 312 is switched in) or to provide a variable width pulse in the output (if the resistor 314 is switched in). The controls can be adjusted to effectively disconnect the A and B oscillators, by biasing off the transistors 484 and 298, respectively, so that either one or both or neither of the A and B oscillators is effective, in controllable amounts.

It will be appreciated that the circuit of FIG. 7 is repeated for each separate key of the keyboard of the instrument, so that a plurality of keys can be simultaneously depressed to contribute signals to the composite output.

It is preferable that the capacitors 454 be selected individually for the circuit of each key, so that they provide the appropriate decay for each note. Preferably the decay time constant for each note should be inversely proportional to the fundamental frequency of each note. The capacitors 500 and 312 are also preferably made individual for the circuit of each key, with the capacitance for each key being inversely proportional to the frequency produced when such key is depressed. The same A and B oscillators 452 and 540 are used for all of these circuits, as are the various control potentiometers, the oscillator 404 and its modulators 406 and 410. The taps of the several potentiometers are preferably connected to busses which interconnect the common points of the circuits for all the keys, so that all of the key circuits are controlled simultaneously.

Similarly, the junction of the resistors 400 and 402 is connected to another bus which is connected to the capacitor 87 – resistor 89 circuit of each key of the keyboard.

The circuit of FIG. 7 lends itself to being readily constructed in integrated circuit form, with several circuits for several keys of the keyboard being provided in a single multi-pair package.

In a modification of the apparatus of FIG. 7, a high frequency oscillator is connected to the movable contact of the switch 66, by a variable capacitor, the capacitance of which is dependent on the force with which a key of the keyboard is depressed, similar to the variable capacitor keys disclosed and claimed in the application Ser. No. 479,444. The relative amount of the high frequency signal which is fed through the key switch while the key is closed depends on the force with which the key is depressed, and so the sustain level of the envelope signal is dependent on the force with which the respective key is depressed.

The versatility of the apparatus illustrated in FIG. 7 is apparent from the waveforms of the envelope (FIGS. 8A–8F) which may be produced by making adjustments in the various potentiometers. By this means the slope of the leading edge of the waveform is adjusted by the potentiometer 408 (FIGS. 8A, C, D and F), the amount of dynamic range (proportional to the velocity) with which the key is depressed is determined by the setting of the potentiometer 85 (FIGS. 8B, C, D and F), the lowest level (i.e., the level with no dynamic range) of the envelope is set by the potentiometer 91 (FIGS. 8B, C, D, and E), the final height of the envelope (with the key held depressed) is determined by the setting of the potentiometer 412 (FIGS. 8A, C–F), and the decay of the envelope may be rapid or gradual, depending on the setting of the switch 440 and, if gradual, the rate is determined by the position of the control 460 (FIGS. 8A, B and D).

From the foregoing, embodiments of the present invention have been described with sufficient particularity as to enable others skilled in the art to make and use the same. It will be apparent that various modifications and additions may be made without departing from the essential features of novelty of the invention, which are desired to be defined and secured by the appended claims.

What is claimed is:

1. An electronic musical instrument having a keyboard with a plurality of keys, said instrument producing musical sounds at pitches corresponding to said keys, and including a weight mounted in each of said keys, sensing means for sensing the momentum with which each of said keys is operated, envelope producing means responsive to said sensing means for producing an envelope signal in response to the momentum with which one of said keys is operated and in response to the time interval since previous operation of said key, said key having a pivotally mounted operating lever and contact means operated by said lever as said key is operated, said contact means being adapted to open a normally closed circuit and subsequently to close a normally open circuit, said contact means comprising a spring having one end connected to a fixed location and the other end connected to said lever, a first conductor normally in contact with said spring for completing said normally closed circuit, and a second conductor spaced from said spring for completing said normally open circuit, a capacitor connected with said spring, means connecting said first conductor to a source of potential for normally charging said capacitor to said potential, a resistor connected in parallel with said capacitor for discharging said capacitor beginning with the opening of said normally closed circuit, a second capacitor connected with said second conductor for sensing the voltage level of said capacitor on the closing of said normally open circuit, means including said normally open circuit for charging said second capacitor for a short time interval to a level determined in part by the voltage level of said first capacitor at the time said normally open circuit is closed, and in part by the difference in potential between the voltage across said second capacitor at the time of closing of said normally open circuit and a source of supply potential, means for discharging said second capacitor at a controlled rate less than the rate at which said second capacitor is charged when said normally open circuit is closed, whereby said second capacitor is charged to successively higher levels in response to successive operations of said key, signal generating means for producing an AC signal at a frequency corresponding to the operated key, and means for discharging said second capacitor at a rate proportional to said frequency.

2. An electronic musical instrument having a keyboard with a plurality of keys, said instrument producing musical sounds at pitches corresponding to said keys, and including a weight mounted in each of said keys, sensing means for sensing the momentum with which each of said keys is operated, envelope producing means responsive to said sensing means for producing an envelope signal in response to the momentum with which one of said keys is operated and in response to the time interval since previous operation of said key, and magnetic means for generating a force opposing operation of said key during initial movement of said key, and for generating a force assisting the operation of said key after said key has been moved, during its operation, more than a predetermined distance.

3. Apparatus according to claim 2, wherein said magnetic means comprises first permanent magnet means secured to said key and movable therewith during operation of said key, and second permanent magnet means located in a fixed position juxtaposed with the path of said first permanent magnet means as said key is operated.

4. Apparatus according to claim 3, wherein said first and second permanent magnet means each have a plurality of poles alternating along a line generally parallel to the direction of movement of said first permanent magnet means as said key is operated, said first and second permanent magnet means having opposite magnetic poles disposed opposite each other when said key is unoperated, said first permanent magnetic means being movable toward and past a position in which opposite magnetic poles are juxtaposed with each other.

5. An electronic musical instrument having a keyboard with a plurality of keys, said instrument producing musical sounds at pitches corresponding to said keys, and including a weight mounted in each of said keys, sensing means for sensing the momentum with which said keys are depressed, wave shape producing means connected to said sensing means and responsive thereto for producing a wave shape responsive to operation of said keys, the parameters of said wave shape being a function of the momentum with which said keys are depressed, said wave shape producing means including charging means for charging a capacitor when one of said keys is depressed, and discharging means for periodically incrementally discharging said capacitor at a rate proportional to the pitch of the sound produced in response to depression of said key.

6. Apparatus according to claim 5, including second discharge means for discharging said capacitor at an adjustable rate, and manual control means for selecting said adjustable rate.

7. An electronic musical instrument having a keyboard with a plurality of keys, said instrument producing sounds at pitches corresponding to said keys, and including a weight mounted in each of said keys, sensing means for sensing the momentum with which said keys are depressed, wave shape producing means connected to said sensing means and responsive thereto for producing a wave shape responsive to operation of said keys, the parameters of said wave shape being a function of the momentum with which said keys are depressed, a plurality of capacitors, one for each of said keys, charging means for each of said capacitors for charging said capacitor individually in response to depression of its respective key, and selectively operable discharge means for discharging said capacitors, said discharge means including means for incrementally discharging each of said capacitors at a rate proportional to the pitch of the sound produced in response to depression of each said key.

8. Apparatus according to claim 7, including second discharge means for discharging said capacitors at a manually adjustable rate, and a plurality of manually controllable devices for selecting said adjustable rate.

9. An electronic musical instrument having a keyboard with a plurality of keys said instrument producing muscial sounds at pitches corresponding to said keys, and including signal generator means for selecting one of a plurality of signals in response to depression of one of said keys, an output system for converting said signal into sound waves, and wave form producing means responsive to depression of said key for generating an envelope signal for modulating said signal, said wave form producing means including charging means for charging a capacitor in response to depression of said key, and discharge means for discharging said capacitor at a rate determined partially by the frequency of said signal.

10. An electronic musical instrument having a keyboard with a plurality of keys, said instrument producing musical sounds at pitches corresponding to said keys, and including signal generator means, means for selecting one of a plurality of signals in response to depression of one of said keys, an output system for converting said signal into sound waves, modifying means interposed between said signal generator means and said output system, said modifying means comprising two pulse generating means connected with said signal generating means for supplying two trains of output pulses to said output system at substantially the same frequency, and means responsive to said key depression for independently modifying the duration of the pulses at each of said trains.

11. Apparatus according to claim 10, wherein one of said pulse generating means is adapted to selectively supply a train of sawtooth pulses.

12. Apparatus according to claim 10, wherein one of said pulse generating means is adapted to selectively supply a train of rectangular pulses.

13. An electronic musical instrument having a source of tone signals, an output system for converting said tone signals into sound waves, pulse width modulator means interposed between said source of tone signals and said output system, and a keyboard having a key for establishing a connection between said pulse width modulator means and said output system, said source of tone signals including means for generating two tone signals having approximately the same frequency, and said pulse width mod lator means including means for individually determining the widths of pulses derived individually from said two tone signals without modifying their shape.

14. Apparatus according to claim 13, including selectively operable means for selecting a predetermined wave shape for one of said tone signals.

15. In an electronic musical instrument, the combination comprising a keyboard having a plurality of keys, a single-pole switch associated with at least one key of said keyboard, means for closing said switch when said key is depressed, a storage capacitor, charging means for charging said capacitor while said switch is closed, first manually adjustable means for variably controlling the rate of charge supplied by said charging means to said capacitor, and second manually adjustable means for variably controlling the final steady state charge on said capacitor while said key remains depressed, a source of pulses, said first manually adjustable means comprising means for adjusting the width of said pulses, said second manually adjustable means comprising means for adjusting the amplitude of said pulses, and means for connecting said first and second adjustable means to said switch during the time said switch is closed and open.

16. Apparatus according to claim 15, wherein said charging means comprises a transistor and a resistor connected in series between said storage capacitor and a source of potential, and means for connecting the base of said transistor with a normally open contact of said switch.

17. In an electronic musical instrument have a keyboard with a plurality of keys, the combination comprising switch means associated with at least one of said keys for closing an electrical circuit when said key is depressed, means responsive to the closing of said electrical circuit for producing an envelope signal, first and second balanced modulators, means connecting the outputs of said balanced modulators in common, modulator control means connected to receive said envelope signal and to control operation of both of said balanced modulators in response to said envelope signal, a first oscillator connected to said first balanced modulator, a second oscillator connected to said second balanced modulator, and manually adjustable means interconnected with said first and second oscillators for independently controlling the amplitude and wave shape of the signals supplied thereby to said modulators.

18. Apparatus according to claim 17, wherein said first and second oscillators are both rectangular wave oscillators, and wherein said manually adjustable means comprises means interconnected between said first oscillator and said first balanced modulator for adjusting the width of pulses supplied by said first oscillator to said first modulator, and means interconnected between said second oscillator and said second balanced modulator for selectively modifying the wave shape of the signal supplied by said second oscillator to said second balanced modulator.

* * * * *